United States Patent [19]

Mizuma

[11] 4,456,238

[45] Jun. 26, 1984

[54] DUPLEX TRAY FOR DUPLEX COPYING MACHINE AND THE LIKE

[75] Inventor: Kenichi Mizuma, Kawasaki, Japan

[73] Assignee: Ricoh Company, Ltd., Japan

[21] Appl. No.: 361,875

[22] Filed: Mar. 25, 1982

[30] Foreign Application Priority Data

Mar. 31, 1981 [JP] Japan ..... 56-48239
Mar. 31, 1981 [JP] Japan ..... 56-46551

[51] Int. Cl.[3] ..... B65H 5/22; B65H 1/04; B65H 3/06

[52] U.S. Cl. ..... 271/3.1; 271/127; 271/251; 271/303

[58] Field of Search ..... 271/303, 213, 117, 118, 271/127, 251, 9, 3.1; 355/145 H

[56] References Cited

U.S. PATENT DOCUMENTS 3,645,615 2/1972 Spear, Jr. ..... 355/3
3,900,192 8/1975 Gibson ..... 271/3.1
4,157,822 6/1979 Miller ..... 271/3.1
4,379,549 4/1983 Mizuma ..... 271/3.1

FOREIGN PATENT DOCUMENTS 189945 11/1982 Japan ..... 271/127

OTHER PUBLICATIONS

IBM Tech. Disclosure Bulletin, Overton et al., "Duplexing Copier", vol. 23, No. 9, Feb. 1981.

*Primary Examiner*—Bruce H. Stoner, Jr.

*Assistant Examiner*—Lisa Rosenberg

*Attorney, Agent, or Firm*—Guy W. Shoup

[57] ABSTRACT

A duplex tray is provided for an automatic duplex copying machine, or the like, for receiving and stacking thereon one-side-copied and for re-feeding those sheets into the machine in order to perform printing on the other side of each sheet, having, a gate for switching the sheet transportation directions from a sheet path for discharging sheets outside the machine to a sheet path for discharging sheets onto the duplex tray, and vice versa; a tray pressure application member means for moving the tray between (i) a reference position and (ii) a position deviated outwards from the reference position; an inclined roller which is movable upwards and downwards and can line up the sheets discharged onto the tray; whereby, at the time of sheet discharging, the gate is moved to the side of the sheet discharging path of the tray, and the tray pressure application member is moved to a non-pressure application position, and the tray is moved to a position deviated from the reference position and the inclined roller is moved to a descended position. In this duplex tray, by selecting either a sheet discharge mode or a sheet re-feed mode, a single solenoid is energized or deenergized, whereby a single half-turn cam is controlled through a spring clutch, and by that cam, the gate, the tray pressure application member and the inclined roller are displaced through a linkage mechanism to their respective positions for discharging sheets onto the tray or for re-feeding sheets.

2 Claims, 18 Drawing Figures

DUPLEX TRAY FOR DUPLEX COPYING MACHINE AND THE LIKE

FIELD OF THE INVENTION

The present invention relates to a duplex tray for an automatic duplex copying machine or automatic duplex printing machine or the like, which duplex tray serves to receive one-side-copied or printed sheets and to stack them until they are fed again for copying or printing on the other side thereof, and further relates to a sheet reversing apparatus for reversing the one-side-copied or printed sheets before they are discharged onto the aforementioned duplex tray.

BRIEF DESCRIPTION OF THE DRAWINGS

In the drawings,

FIG. 12 shows a state in which the solenoid is deenergized (OFF), while FIG. 13 shows a state in which the solenoid is energized (ON).

DESCRIPTION OF PRIOR ART

In performing duplex copying or duplex printing by an automatic duplex copying machine or by an automatic duplex printing machine, one-side-copied or one-side-printed sheets are reversed and temporarily stacked on a duplex tray. When an original used for the first copying or printing is replaced by another original, the sheets that have been temporarily stacked on the duplex tray are fed again to the duplex copying machine or the duplex printing machine.

Figure 1:
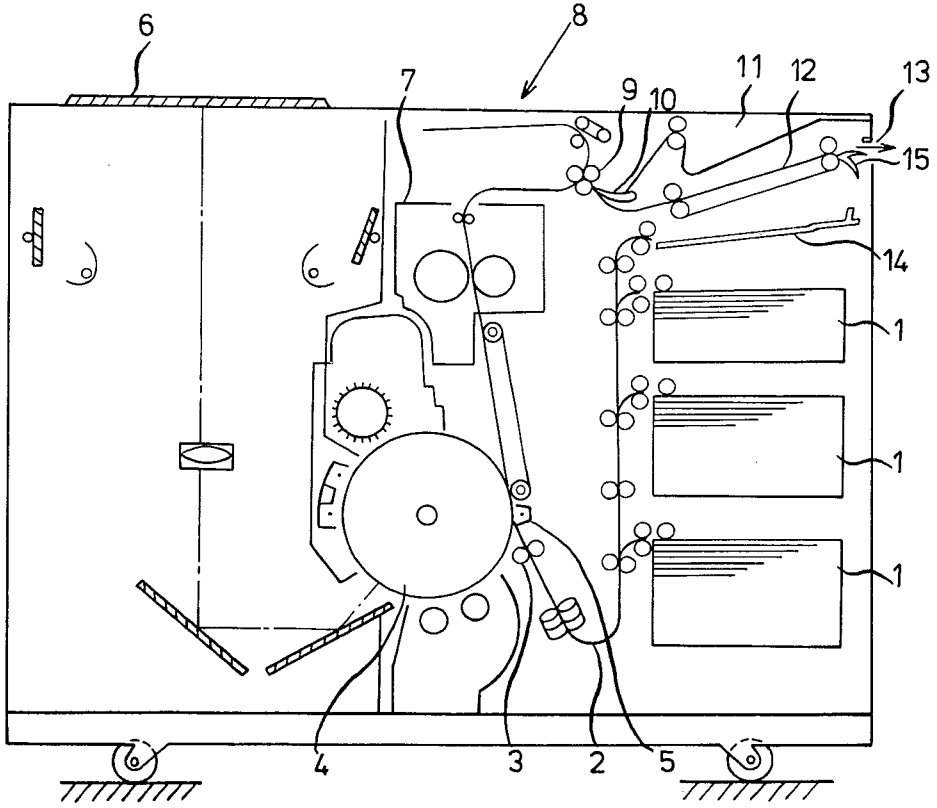
FIG. 1 is a schematic illustration of the structure of an example of a conventional duplex copying machine.

Referring to FIG. 1, the entire structure of an example of an automatic duplex copying machine will now be described briefly.

A sheet which has been fed from a sheet supply cassette 1, with one-side reference, is caused to pass through a buffer section 2, and the leading edge of the sheet reaches a register roller 3. The sheet is synchronized with the rotation of a photoconductor drum 4 and then fed to an image transfer section 5. A toner image corresponding to an image of an original 6, formed on the photoconductor drum 4 by a predetermined series of steps, is transferred to the sheet at the image transfer section 5. The sheet is then separated from the photoconductor drum 4 and transported to an image fixing section 7 where the toner image is fixed permanently to the sheet by heat rollers, and is then transported to a sheet discharge section 8. At an inlet of the sheet discharge section 8, there is disposed a sheet reversing apparatus comprising, for instance, three rollers. By the sheet reversing apparatus, the leading side and rear side or the front side and back side of the sheet are reversed or not reversed by changing the relative positions of the rollers. The sheet is then transported to a first gate 10. The first gate 10 can be switched by a solenoid (not shown) to a path leading to a sheet discharge tray 11 or to a path leading to a belt conveyor section 12. At the extreme end of the belt conveyor section 12, there is disposed a second gate 15 capable of switching the transportation direction of the sheet to an outlet 13 connected to a sorter provided outside of the copying machine or to a path leading to a duplex tray section 14.

When the first side copying is performed in duplex copying, the second gate 15 is switched to the side of the duplex tray section 14, and the first-side-copied sheets are fed to the duplex tray section 14 and are stacked on the tray. When a designated number of the first-side copying has been completed, the original is replaced by another original, and the sheets stacked on the duplex tray section 14 are individually re-fed by the sheet feeding rollers of the duplex tray. When the second side copying has been completed by a similar process to the above, the sheets are discharged onto the sheet discharge tray 11 or to the sorter through the outlet 13 connected to the sorter for collation, as the case may require.

Sheet transportation modes of this copying machine can be roughly classified as follows:

(a) Sheet discharge mode under which sheets are discharged onto the sheet discharge tray;

(b) Sorter mode under which sheets are discharged into the sorter section; and (c) Duplex copying mode under which sheets are discharged onto the duplex tray section and stacked there and then fed again to the copying machine.

In this copying machine, there is independently provided a sheet reversing apparatus 9 capable of switching between sheet-reversing and sheet-non-reversing, upstream of the first gate 10. Therefore, collating of the discharged copy sheets, or one-side double copying can be done as desired by selecting the reversing or non-reversing of sheets under each mode.

When the stacked sheets are re-fed from the duplex tray, it is necessary to line up the sheets discharged to the duplex tray and stacked thereon, by setting the leading edges or side edges thereof in conformity with a predetermined reference line, in order to prevent problems, such as longitudinal or transverse positional deviation or skewing of the sheets from the photoconductor drum or from a printing roller.

Figure 2:
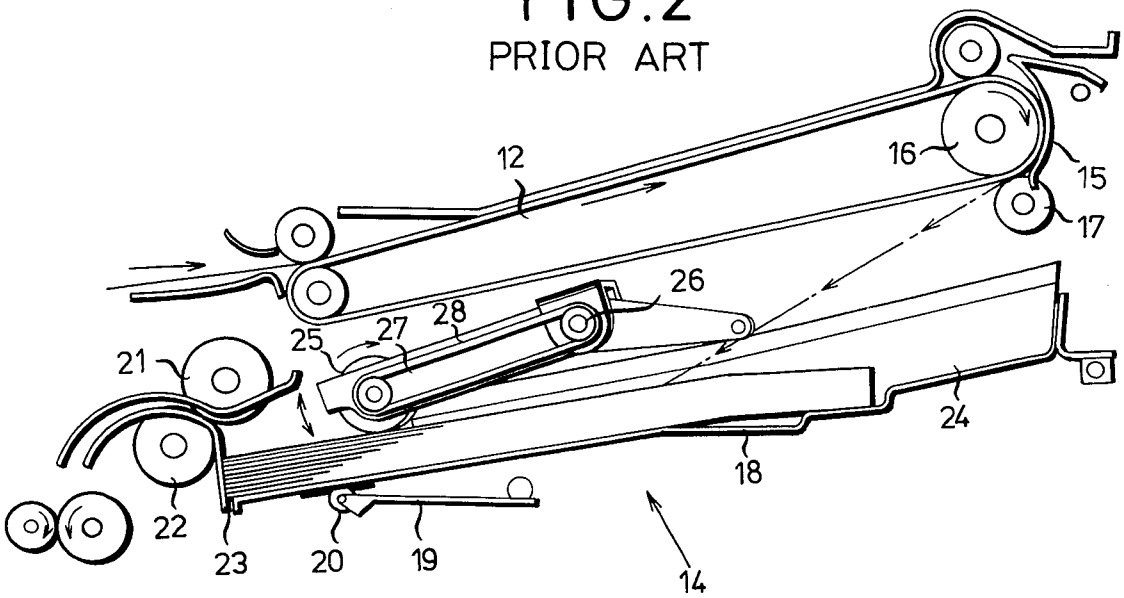
FIG. 2 PRIOR ART
FIG. 2 is a schematic sectional view of a duplex tray section of the duplex copying machine in FIG. 1, at the time when the duplex tray section receives sheets.
Figure 3:
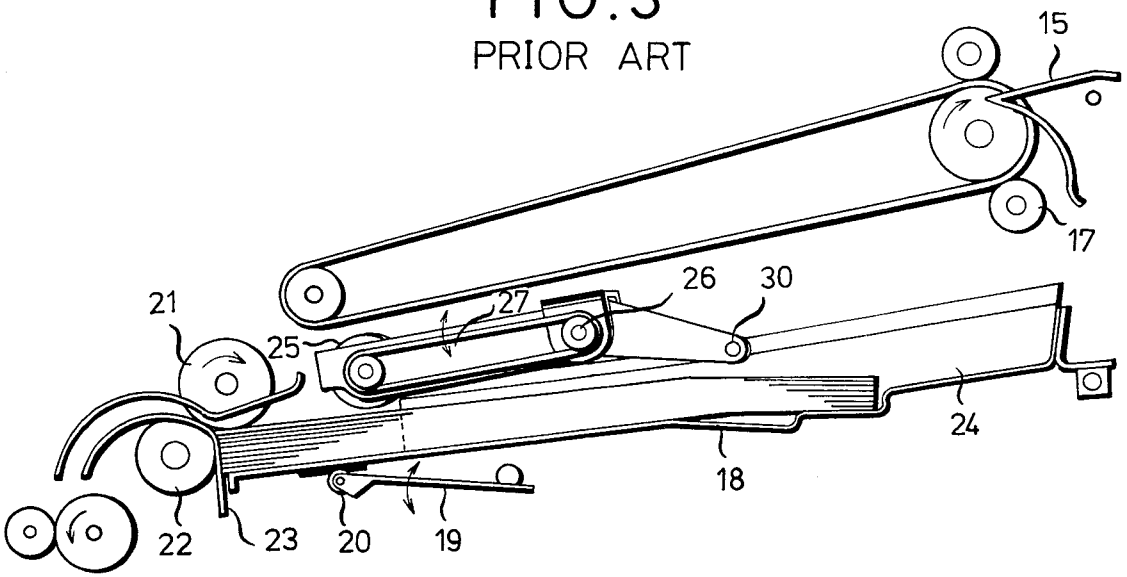
FIG. 3 PRIOR ART
FIG. 3 is a schematic sectiona view of the duplex tray section in FIG. 2 at the time when the sheets are fed again to the copying machine.

An example of a conventional duplex tray apparatus which can successfully solve the above-described problems will now be explained by referring to FIGS. 2 and 3.

When a duplex mode is selected, the second gate 15 is switched towards the duplex tray section 14. One-side-copied sheets which have been subjected to image fixing and then reversed by the sheet reversing apparatus 9 are then transported through the belt conveyor section 12, making a U-turn along a turn roller 16 and a guide surface of the second gate 15. They are discharged individually onto a tray 18 by a discharge roller 17, against a side reference, regardless of the difference in size of the sheets, and are stacked on the tray 18. When a predetermined number of sheets has been discharged, the tray 18 is pushed at its lower surface by a pressure application roller 20 which is rotatably supported by the top portion of a tray pressure-application arm 19 for applying pressure to the tray 18. As a result, a front portion of the top surface of the stack of sheets, corresponding to a front portion of the tray 18, is brought into pressure contact (at an appropriate sheet feeding pressure) with a sheet feeding roller 21 which is rotatably supported by the frame of the copying machine. The sheets are individually re-fed at a predetermined timing for second-side copying from the tray 18 by the sheet feeding roller 21 and the sheet separation roller 22.

In this apparatus, as the means for lining up the sheets discharged onto the tray 18, there are provided a front bump plate 23 which lines up the leading edges of the sheets and serves as a reference surface, a reference side wall 24 with which the side edges of the sheets are brought into contact to line up the side edges of the sheets, an inclined sponge roller 25 for transporting the sheets individually towards the front bump plate 23 and towards the reference side wall 24. The front bump plate 23 is disposed near the front edge of the tray 18, at a right angle with respect to the sheet feeding direction, and fixed to the frame of the copying machine. The upper end portion extends to become a guide plate for refeeding sheets. The reference side wall 24 is disposed integrally with the tray 18, in the direction normal to the front plate 23 and to the stacking surface of the tray 18.

Figure 4:
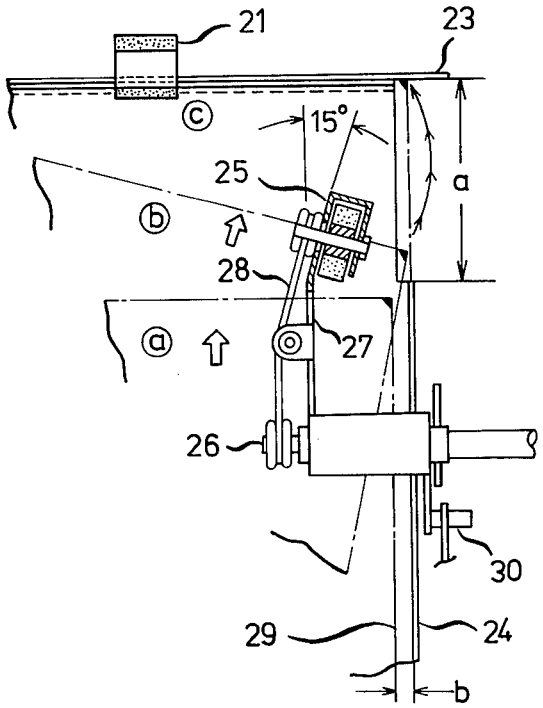
FIG.4 PRIOR ART
FIG. 4 is a plan view in explanation of the function of an inclined roller employed in the duplex copying machine in FIG. 1.

As shown in FIG. 4, the reference side wall 24 is disposed upstream of the front bump plate 23, and at a side edge of the tray 18, except a portion a thereof. When sheets are discharged, the tray 18 shifts transversely in such a manner that the inner side of the reference side wall 24 is shifted by a distance b towards the outside from a sheet passing reference line 29.

The inclined sponge roller 25 is disposed near a front corner of the tray 18 on the same side as the reference side, with an inclination of about 15°. The inclined sponge roller 25 is rotatably supported on a free end portion of an inclined roller arm 27 which is swingably supported on a drive shaft 26. The inclined sponge roller 25 is continuously drive in rotation during sheet discharging, in the direction of the arrow as shown in FIG. 2 by a drive belt 28 trained over the drive shaft 26 and the inclined sponge roller 25 and, at the same time, by gravity, it is brought into pressure contact with a top sheet of the stack of sheets placed on the tray 18, rotating in contact with the top sheet. Thus, the roller 25 applies a force to each sheet discharged onto the tray 18, in a forwardly inclined direction, so that a sheet discharged at a position ⓐ in FIG. 4 is inclined to a position ⓑ. After an upper, left corner of the sheet is brought into contact with the front bump plate 23, an upper, right corner of the sheet follows an arc-shaped path indicated by a series of arrows, so that the leading edge of the sheet is caused to coincide with the front plate 23, while the side edge thereof is caused to coincide with the reference side wall 24. The transportation force of the inclined sponge roller 25 is so weak that the roller 25 slips on the sheet after that sheet is placed in the right position ⓒ in contact with both the front plate 23 and the reference side wall 24. Therefore, jamming of the sheet does not take place.

When the sheets stacked on the tray 18 are re-fed for second-side copying, the following steps are done: A push-up pin 30, provided integrally with the inclined roller arm 27, is pushed down, whereby the inclined sponge roller 25 is retracted from the stack of sheets and its rotation is stopped. The tray 18 is moved transversely by a distance b and the side edge of the stack of lined-up sheets is caused to coincide with the sheet passing reference line 29. The tray 18 is pushed upwards by the tray pressure application roller 20, so that the upper surface of the stack of sheets is brought into pressure contact with the sheet feed roller 21. As a result, sheets are individually fed from the stack by the sheet feed roller 21 and sheet separation roller 22, with the reference position kept exactly.

From the above, the actions of the main elements required for discharging sheets to the duplex tray section, stacking and lining up the sheets and re-feeding the sheets can be summarized as follows:

(i) Switching the sheet discharging direction by the second gate;
(ii) Releasing and applying the sheet feeding pressure by the duplex tray;
(iii) Moving the duplex tray in a transverse direction;
(iv) Moving the inclined sponge roller upwards and downwards; and
(v) Rotating the inclined sponge roller and stopping the same.

Conventionally, the above-mentioned five actions each are controlled by use of different solenoids or clutches. Therefore, not only high costs, but also much space is required. The result is that the layout of those components is complicated and the size of the copying machine is bulky.

The previously described sheet reversing apparatus 9 comprising three rollers is capable of reversing sheets which are discharged continuously at short intervals at a high speed, without requiring much space. This was invented by the inventor of the present invention and is disclosed in Japanese Patent Application No. 55-23370.

Figure 5:
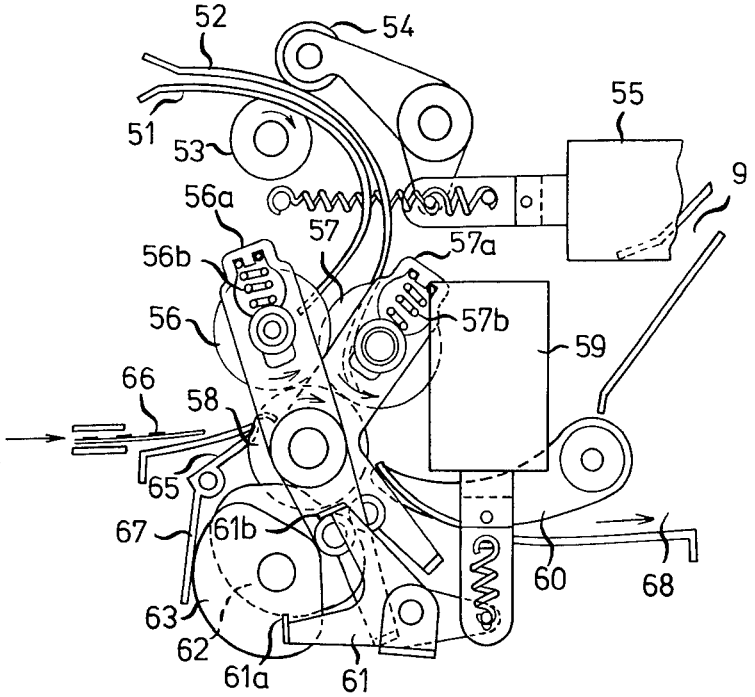
FIG.5 PRIOR ART
FIG. 5 is a side view of an example of a conventional three-roller type sheet reversing apparatus, at the time when sheets are not reversed.

The structure of the sheet reversing apparatus 9 is shown in FIG. 5, in which a main reversing roller 58 is driven in rotation, and two reverse rollers 56 and 57 are disposed to form a sheet passage through which sheets are transported from an image fixing section of a copying machine. The reverse rollers 56 and 57 are respectively supported rotatably on the shafts mounted near arms 56*a* and 57*a* which are supported on the shaft of the main reverse roller 58, and are brought into pressure contact with the main reverse roller 58 by coil springs 56*b* and 57*b*. The reverse roller 56 is disposed upstream of the sheet passage, while the reverse roller 57 is disposed downstream of the sheet passage. These three rollers each comprise short coaxial rollers mounted side by side on the shaft of each roller. The arms 56*a* and 57*a* respectively engage cams 63 and 62 fixed to a cam shaft. As the cams 63 and 62 move, the reverse rollers 56 and 57 are moved in pressure contact with the peripheral surface of the main reversing roller 58. Under an "normal mode" wherein the sheets are transported without being reversed, the reverse rollers 56 and 57 are positioned in proximity with each other or at such crossing positions as shown in FIG. 5. Under a "reverse mode" wherein the sheets are reversed, the reverse rollers 56 and 57 are held separately as shown in FIG. 6.

Figure 6:
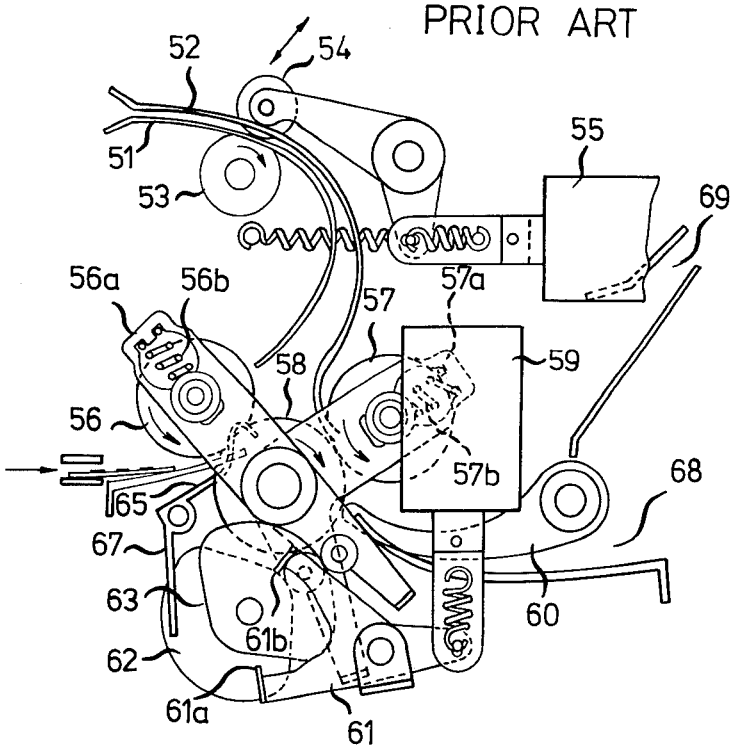
FIG. 6 PRIOR ART
FIG. 6 is a side view of the three-roller type sheet reversing apparatus shown in FIG. 5, at the time when sheets are reversed.

Under the reverse mode as shown in FIG. 6, an inlet of a sheet reversing section formed between a pair of guide plates 51 and 52 is open in the sheet discharging direction of a sheet 66 which is transported between the reverse roller 56 on the upstream side and the main reverse roller 58. In other words, the inlet is open in the direction of the tangent at the contact point of the above-mentioned two rollers 56 and 58. The leading edge of the sheet 66 comes into contact with the guide plate 52, with an inclination with respect to the guide plate 52. As a result, the sheet 66 changes its travelling course and is transported along the guide plate 52 to the reversing section. The lower end portion of the guide plate 52 is curved towards the downstream side so as to allow a sheet pushed backwards by return rollers 53 and 54 (that will be described later on) to enter between the reversing roller 57 on the downstream side and the main reversing roller 58.

Figure 7:
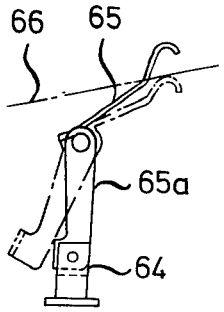
FIG. 7 PRIOR ART
FIG. 7 is a side view of a sheet detecting means employed in the three-roller type sheet reversing apparatus shown in FIG. 5.

Further, a reversely-rotating roller 53 which is always rotated in such a direction as to push sheets backwards, and a pinch roller 54 which is separable from the reversely-rotating roller 53 by a return solenoid 55, are provided so as to control therebetween the sheet passage formed by the guide plates 51 and 52 of the reversing section. Energizing and deenergizing, that is, turning on and off of the return solenoid 55 is controlled by a photo-interrupter 64, which is actuated by a top portion of a sheet detection feeler 65 being projected into the sheet passage immediately behind the contact point of the upstream-side reverse roller 56 and the main reverse roller 58, under the reversing state as shown in FIG. 6. The feeler 65 is then pushed downwards by the sheet 66 as shown by the chain lines in FIG. 7, and a light shielding plate 65*a* fixed to its shaft is retracted from the light path. When the feeler 65 is pushed downwards by the sheet 66, the return solenoid 55 is deenergized (off) and the pinch roller 54 is moved away from the reversely-rotating roller 53. On the other hand, when no sheet is passing over the feeler 65, the return solenoid 55 is energized (on), and the pinch roller 54 is in pressure contact with the reversely-rotating roller 53.

The cams 62 and 63 for changing the positions of the reverse rollers 56 and 57, in order to switch the operation modes from the normal mode as shown in FIG. 5 to the reverse mode as shown in FIG. 6 and vice versa, are changed in position by a spring clutch (not shown) which is actuated by the engagement of engagement pawls 61*a* and 61*b*. The engagement pawls 61*a* and 61*b* are formed so as to face each other in the end portions of a two-forked arm of a reverse-set lever 61 which is rotated around a fixed shaft thereof by a reverse-set solenoid 59.

Immediately behind the sheet pinching portion between the main reverse roller 58 and the downstream-side reverse roller 57, there is disposed a gate 60 for switching the sheet passages from the passage 68 leading to the belt conveyor section to the passage 69 leading to the discharged sheet tray and vice versa.

In the normal mode in which sheets are transported without being reversed in this apparatus, the return solenoid 55 and the reverse-set-solenoid 59 are both deenergized (off), and the reverse set cams 63 and 62 are maintained in such a state as shown in FIG. 5 by the reverse set lever 61 and a position-setting spring clutch. The reverse rollers 56 and 57 are positioned in proximity to each other (or at the crossing positions), and respectively disposed at the other end portions of the arms 56*a* and 57*a* which engages the reverse set cams 63 and 62 through a cam follower. The sheet 66 discharged from the image fixing section is held between the upstream-side reverse roller 56 and the main reverse roller 58 and is then held between the downstream-side reverse roller 57 and the main reverse roller 58. Therefore, the sheet 66 is transported, without being reversed, to one of the passages 68 and 69, which is selected by the gate 60. In this case, since the sheet detection feeler 65 is unnecessary, the top end portion of the feeler 65 is held within the radius of the main reverse roller 58, by the feeler lever 67 being pushed by the cam 63 as shown in FIG. 5. Therefore, it never occurs that the transportation of the sheet 66 is hindered by the sheet detection feeler 65.

In the case of the normal mode, it is preferable that the reverse rollers 56 and 57 be positioned as closely as possible to each other.

Figure 8:
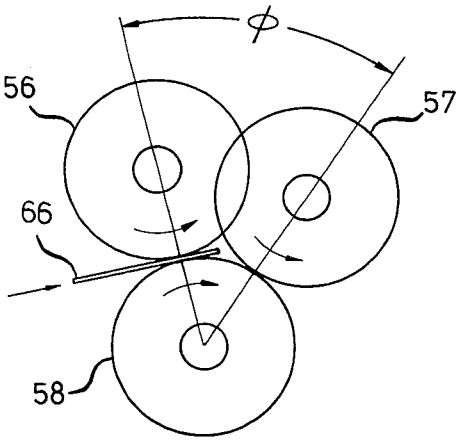
FIG. 8 is a schematic illustration showing the positional relationship between two reverse rollers and a main reverse roller employed in the sheet reversing apparatus shown in FIG. 5.

In an example as shown in FIG. 8 the crossing angle $\phi$ is and hange formed by the straight line passing through the center of the reverse roller 56 and the center of the main reverse roller 58 and by the straight line passing through the center of the reverse roller 57 and the center of the main reverse roller 58. The angle $\phi$ is set at 48 degrees, when the sheet 66 is in the state of face-curl (i.e. the state in which the copy surface is concave), it is necessary to make the peripheral edge portion of the reverse roller 57 round or employ for the reverse roller 57 a material which facilitates slippage of the sheet on the roller 57.

When sheets are transported under the reverse mode, the reverse-set solenoid 59 and the return solenoid 55 are energized (on) as shown in FIG. 6. By the reverse-set solenoid 59 being energized, the reverse-set lever 61 changes its position and controls the position-setting clutch and moves the reverse-set cams 63 and 62 to the positions as shown in FIG. 6 and maintains them at those positions. At the same time, the arms 56*a* and 57*a* are moved, so that the reverse rollers 56 and 57 are held in the open state as shown in FIG. 6. By the movement of the cam 63, the feeler moving lever 67 is set free, and the top end portion of the feeler 65 is projected towards the surface of the passing sheet, immediately behind the contact portion between the main reverse roller 58 and the upstream-side reverse roller 56, but without hindering the passing of the sheet, so that the passing of the sheet can be detected. When the feeler 65 is pushed downwards as shown by the chain lines in FIG. 7 by the leading edge of the sheet during the passage thereof, the light shielding plate 65*a* is retracted from the optical path of the photo-interrupter 64, whereby the return solenoid 55 is deenergized (off).

Therefore, when the sheet 66 transported from the image fixing section is held between the main reverse roller 58 and the upstream-side reverse roller 56 and transported, the leading edge of the sheet 66 comes into contact with the guide plate 52, with an inclination with respect to the guide plate 52, and the transportation direction of the sheet 66 is changed. As a result, the sheet 66 is transported along the guide plate 52 to the reversing section.

Figure 9:
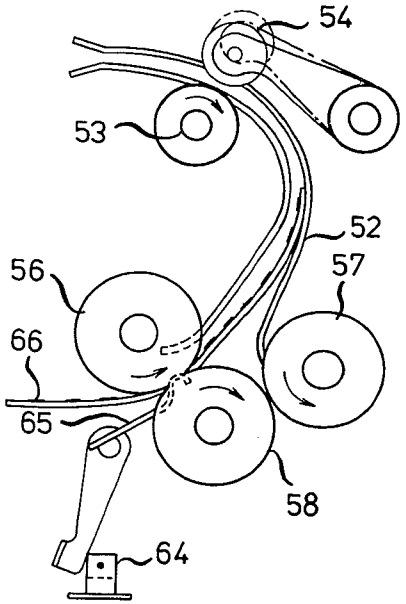
FIGS. 9 through 11 are schematic illustrations in explanation of the sheet reversing action of the sheet reversing apparatus shown in FIG. 5.
Figure 10:
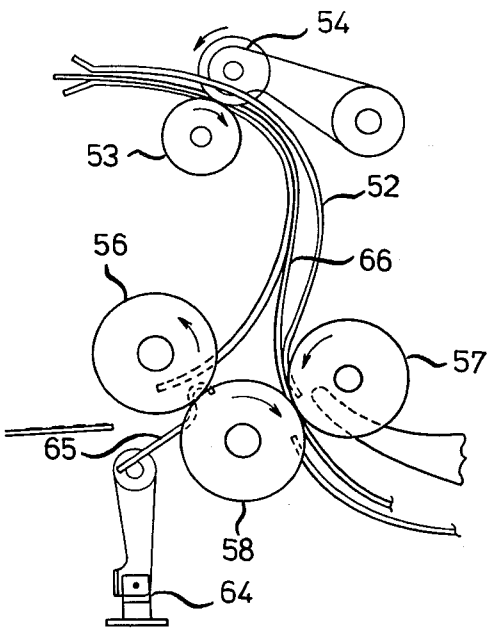

When the sheet 66 is held between the main reverse roller 58 and the upstream-side reverse roller 56 and transported as shown in FIG. 9, the pinch roller 54 and the reversely-rotating roller 53 are separated from each other, so that the sheet 66 is allowed to pass between the two rollers. However, immediately after the rear end portion of the sheet 66 is set free, preceded by its passage through the contact point between the main reverse roller 58 and the upstream-side roller 56, the feeler 65 is returned and the return solenoid 55 is energized (on) through the photo-interrupter 64. The result is that the pinch roller 54 is pushed by the reversely-rotating roller through the sheet, and the sheet is pushed backwards as shown in FIG. 10.

When the lower end portion of the thus pushed sheet comes into contact with the main reverse roller 58, the sheet is caught by both the main reverse roller 58 and the downstream-side reverse roller 57, due to the friction between the sheet and the main reverse roller 58 and due to the rotation of the main reverse roller 58, so that the sheet is discharged to a path selected by the gate 60. As a result, the front side and back side, and the leading side and rear side of the sheet are reversed.

When sheets are transported continuously at short intervals, the leading edge of a following sheet 66*b* comes into contact with the copying surface of a preceding sheet 66*a* which is transported from the reverse section by being held between the downstream-side reverse roller 57 and the main reverse roller 58. The surface of the preceding sheet 66*a* serves as a guide surface for the following sheet 66*b*.

The above-described sheet reversing apparatus was employed in an actual copying machine. The result was that there was no problem with sheet reversing in the sheets free from curls or free from back curls (i.e. curl with the copying surface being convex), but in the sheets with face-curls, dog-eared turning occurred at the corners of the sheets during sheet reversing, and sheet jamming also occurred in the sheet path after the sheet reversing.

The above problems were found to occur for the following reasons:

The sheet is set free during the period from the time when the rear edge of the sheet leaves the upstream-side reverse roller 56 through the time when the pinch roller 54 is pressed by the reversely-rotating roller 53. The rear end portion of the sheet leaves the main reverse roller 58, since the transportation speed is very fast (for example, about 380 mm/sec). Under this condition, since the rear end of the sheet is free, the sheet curls due to its inherent face-curling tendency. Further, in general, since the extent of such curling is not uniform in the direction of the width of the sheet, the timing at which the sheet is pushed backwards by the reversely-rotating roller 53 and is caught by the downstream-side reverse roller 57 varies, so that the dog-eared turning of the sheet is caused. Even if the extent of the curling is uniform in the direction of the width of the sheet, the dog-eared turning occurs as well since catching of the sheet by the downstream-side reverse roller 57 cannot be done smoothly.

SUMMARY OF THE INVENTION

In view of the aforementioned shortcoming of the duplex tray of the conventional duplex copying machine and the like, it is an object of the present invention to provide an easy-to-control, high-reliability and inexpensive duplex tray whose various functions can be controlled by use of a single solenoid.

Another object of the present invention is to provide the necessary conditions for a sheet reversing apparatus comprising three rollers, from which the conventional problems are eliminated.

DETAILED DESCRIPTION OF PREFERRED EMBODIMENT

Referring to FIG. 12 through FIG. 17, embodiments of a duplex tray according to the present invention will now be described.

Figure 13:
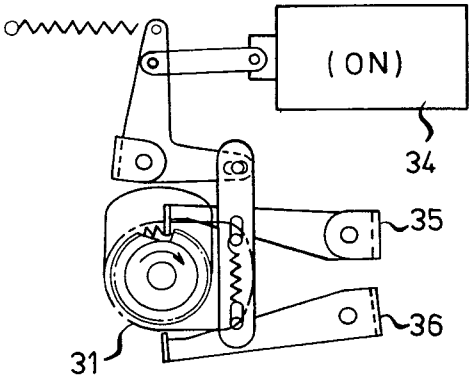
FIGS. 12 and 13 are schematic side views of a solenoid, a cam and a control link for controlling the cam, employed in an embodiment of a duplex tray according to the present invention. In particular
Figure 12:
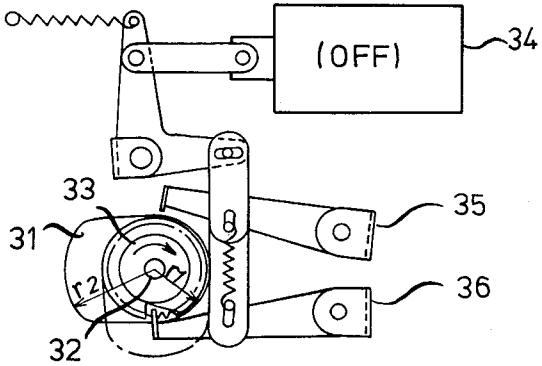

In the embodiments which will now be explained, the control of each member relating to the discharging of sheets onto a duplex tray, lining up and stacking of the sheets, and refeeding of the sheets, is performed by a duplex-set cam 31 as shown in FIGS. 12 and 13. The duplex-set cam 31 includes a semicircular arc portion with a radius of $r_1$ whose center is at the rotating center of the duplex-set cam 31; and arc portion with a radius of $r_2$ which is greater than the radius $r_1$; and a connecting portion for connecting the first-mentioned arc portion and the second-mentioned arc portion in such a manner that the two arc portions are smoothly connected by two substantially parallel straight lines. The duplex-set cam 31 is connected to a drive shaft 32 which is always rotated in the direction of the arrow, through a spring clutch 33.

The duplex set cam 31 is controlled as a half-turn clutch cam by a pair of release levers 35 and 36, which face opposite each other and are caused to engage or disengage a ratchet sleeve of a spring clutch by the duplex-set solenoid 34. In other words, when the solenoid 34 is off as shown in FIG. 12, a lower release lever 36 engages the ratchet sleeve of the spring clutch 33, so that the duplex-set cam 31 is held in such a posture that the portion with the radius $r_2$ is on the left side as shown in the figure. On the other hand, when the solenoid 34 is on as shown in FIG. 13, an upstream-side release lever 35 engages the ratchet sleeve, so that the duplex-set cam 31 is held in such a posture that the portion with the radius $r_2$ is on the right side as shown in the figure.

Figure 14:
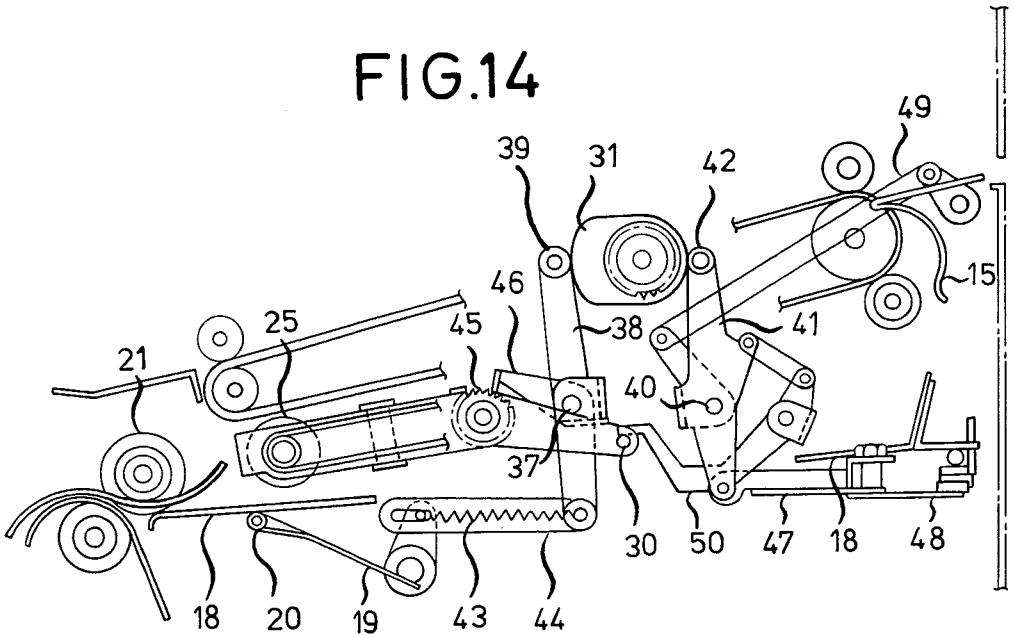
FIG. 14 is a schematic side view of a linkage mechanism of a duplex tray section of the embodiment of the duplex tray according to the present invention, at the time when sheets are not discharged onto the duplex tray.

As shown in FIG. 14, a follower 39 provided at the tip end of a tray pressure release lever 38 which is rotatably mounted on a fixed shaft 37, and a follower 42 provided at the tip end of a tray transverse shift lever 41 which is rotatably mounted on a fixed shaft 40 each engage the cam surface of the duplex-set cam 31 at symmetrical positions 180° apart.

To the other end of the tray pressure lever 38 is connected a duplex tray pressure application arm 19 (previously explained by referring to FIGS. 2 and 3) through a duplex tray pressure application spring 43 and a duplex tray pressure application link 44.

At an external end portion of the drive shaft 26 of the inclinded roller 25 whose function has already been explained by referring to FIG. 4, there is provided a spring clutch 45 which engages a constantly rotating shaft. To the tray pressure release lever 38, there is fixed a release lever 46 of the spring clutch 45.

To the duplex-tray-transverse-shift lever 41 is connected, through a duplex-tray-transverse-shift-connection link 47, a duplex-tray-transverse-shift arm 48 for sliding the duplex tray 18 in a transverse direction. Further, to the duplex-tray-transverse-shift lever 41, there are connected a second gate connection link 49 for opening and closing the second gate 15, and an inclined-roller-lifting arm 50 which engages a lifting pin 30 for lifting the inclined roller 25.

Figure 15:
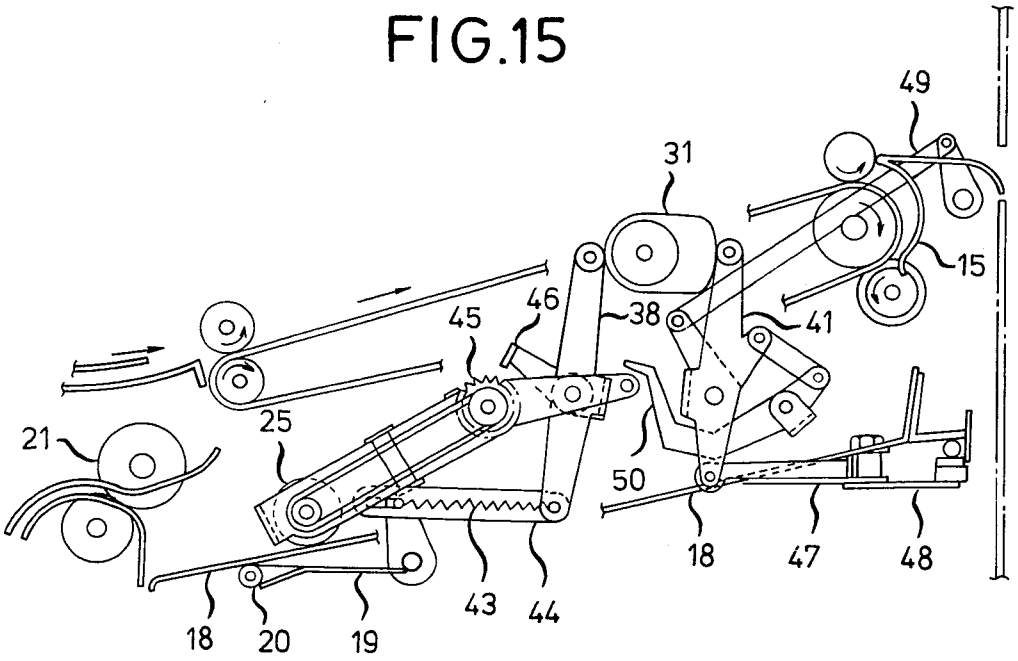
FIG. 15 is a schematic side view of the linkage mechanism shown in FIG. 14, at the time when sheets are discharged onto the duplex tray.
Figure 16:
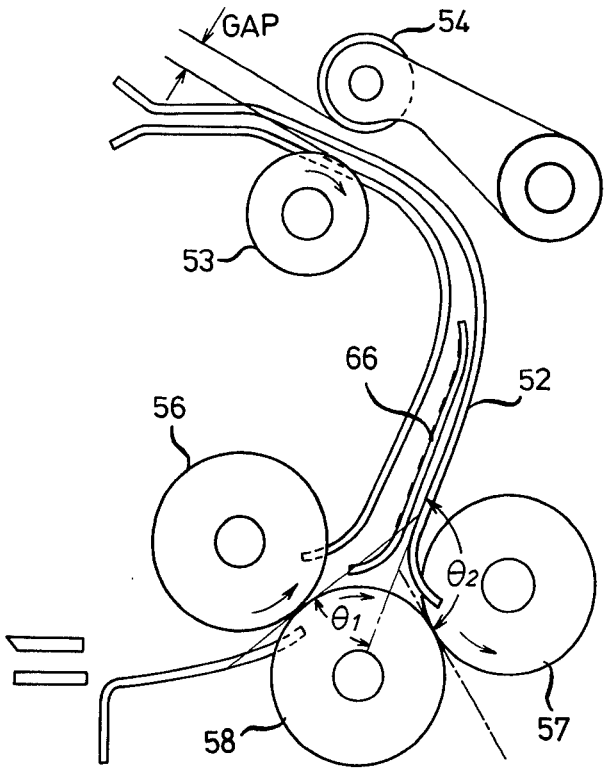
FIG. 16 is a schematic illustration in explanation of the conditions required for smooth sheet reversing and sheet feeding in the previously mentioned 3-roller type sheet reversing apparatus.
Figure 17:
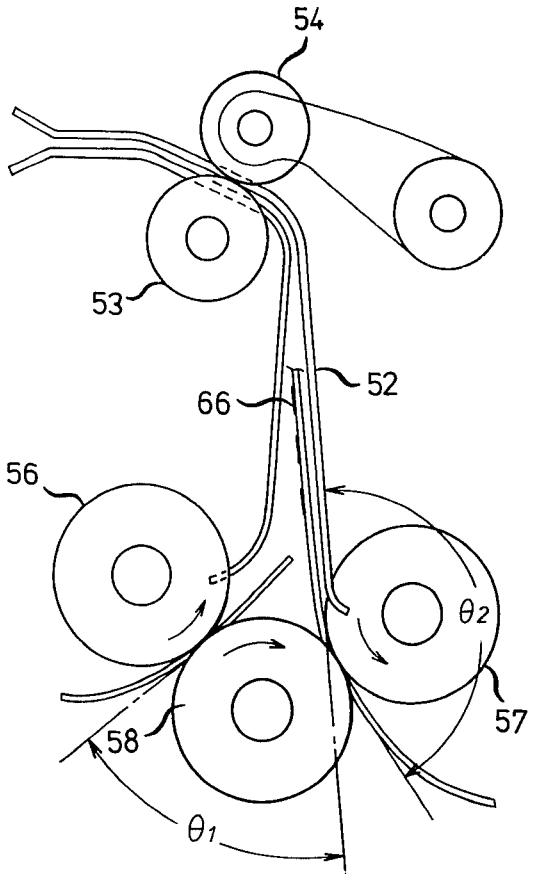
FIG. 17 is a schematic illustration of an example of an inadequate arrangement of the members for the 3-roller type sheet reversing apparatus.

Because of the above-described structure of this apparatus, upon selecting the duplex mode, the solenoid 34 is energized (on), and the duplex-set cam 31 begins to turn clockwise from the posture as shown in FIG. 12. By the first 90 degree-turn, the cam 31 takes a posture as shown by the chain line in FIG. 13, and the pressure release cam lever 38 shown in FIG. 14 rotates clockwise to a position as shown in FIG. 15. As a result, the duplex tray pressure application arm 19 is rotated counterclockwise through the duplex tray pressure application link 44, so that releasing of the sheet feeding pressure of the tray 18 is done, and, at the same time, the release lever 46 of the inclined sponge roller drive spring clutch 45 is released and the inclined roller 25 is driven in rotation clockwise.

By the next 90 degree-turn, the cam 31 is caused to take a posture as shwon by the solid line in FIG. 13 and the transverse shift lever 41 is rotated clockwise from a position as shown in FIG. 14 to a position as shown in FIG. 15. At the same time, the duplex tray 18 is moved by a distance b, in a transverse direction, together with its shaft, by the transverse shift arm 48 through the transverse shift connection link 47. As a result, the reference side wall 24 of the tray 18 is shifted outwards by the distance b from the sheet passing reference line 29 (refer to FIG. 4). Further, at the same time, the second gate 15 is rotated clockwise by the second gate connection link 49, and the inclined roller lifting arm 50 is rotated clockwise and is disengaged from the inclined roller lifting pin 30, so that the inclined roller 25 is caused to move downwards under its own gravity.

During front-side copying, the duplex-set solenoid 34 is always energized (on), and each element takes each posture as shown in FIG. 15. Since the inclined sponge roller 25 is in contact with the top sheet under its own gravity, the height of the stack of sheets changes in accordance with the number of sheets in the stack and the discharged sheets are lined up by the method described in detail previously.

When the front-side copying has been completed, the duplex-set solenoid 34 is deenergized (off), and the duplex-set cam 31 is rotated clockwise from the position shown in FIG. 14 and returns to the initial position shown by the solid line in FIG. 13.

At this moment, the tray 18 is shifted transversely to the sheet reference position when the duplex-set cam 31 comes to the first 90 degree rotated position (i.e. the position indicated by the chain lines in FIG. 12). The second gate 15 is shifted towards the sorter connection outlet, and the inclined roller 25 is moved upwards away from the top sheet. At the last 90 degree rotated position (i.e. the position indicated by the solid lines in FIG. 12), the tray 18 is pushed upwards by the duplex tray pressure application arm 19, and the sheet feed roller 21 is brought into pressure contact with the top sheet, and at the same time, the rotation of the inclined roller 25 is stopped, and each member is maintained at each position as shown in FIG. 14, so that the sheets are re-fed.

In the above-described embodiment, the rotation of the inclined roller 25 is stopped when the roller 25 is not in operation, in order to prevent the abrasion of the drive belt 28. Of course, the inclined roller 25 can be designated so as to be rotated continuously.

As explained above, in the present invention, the operations necessary for discharging sheets from the duplex tray of a duplex copying machine, a duplex printing machine or the like, lining up and stacking of sheets, and re-feeding the sheets, can be controlled by a single cam through a link mechanism, which single cam is controlled by a single solenoid through a spring clutch. Therefore, the control of the apparatus and the mechanism of the apparatus are simplified and therefore, its operational reliability is increased and its cost is significantly reduced.

The conditions necessary for stable performance of the previously mentioned three-roller type sheet reversing apparatus will now be described in detail.

Generally, when the transportation direction of a sheet is changed by bumping obliquely the leading edge of the sheet against a guide surface, whether or not such change of the transportation direction can be done smoothly depends upon the magnitude of the coefficient of friction between the leading edge of the sheet and the guide surface, upon the bumping angle of the sheet against the guide surface, and upon the moving speed relative to the guide surface.

Therefore, whether or not the sheet 66 is smoothly caught by the main reverse roller 58 and by the downstream-side reverse roller 57 in the three-roller type sheet reversing apparatus depends upon the bumping angle of the lower portion of a sheet against the main reverse roller 58. The sheet is guided near the lower portion of the guide plate 52 (except the forwardly curved portion of the lower portion) and is returned through the sheet reversing section. In other words, the smooth catching of the sheet 66 depends upon the angle $\theta_2$ formed by a tangent at the contact point between the main reverse roller 58 and the downstream-side reverse roller 57, and a line indicating the guiding direction of the sheet returned through the sheet reversing section by the guide plate 52. In the previously described sheet reversing apparatus which was employed in practice in an actual machine, $\theta_2$ was approximately 130°, and the gap between the reversely-rotating roller 53 and the pinch roller 54 was approximately 4 mm. Therefore, a reversing force was not applied to the sheet immediately after the rear end of the sheet was detached from the upstream-side reverse roller. As a result, the rear end of the sheet was detached from the reverse roller 58. The angle $\theta_1$ formed by the tangent at the contact point between the main reverse roller 58 and the upstream-side reverse roller 56, and the guide plate 52 at the intersection point of the tangent, was about 28° in the above apparatus.

Figure 11:
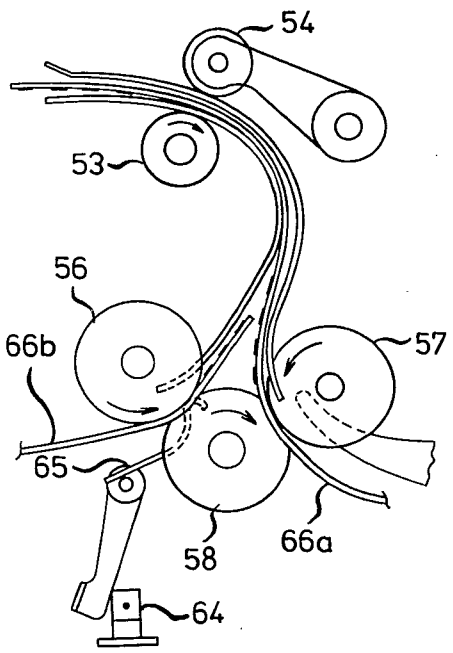

It is apparent that the catching and transportation of the sheet by the main reverse roller 58 and the downstream-side reverse roller 57 can be done smoothly by increasing the angle $\theta_2$ by inclining the guide plate 52 in such a manner that its perpendicular or lower portion comes forwards. In this case, however, the angle $\theta_1$ is also increased. In the case of a one-to-one copying process in which one copy is made from one original, there is no problem even if the angle $\theta_1$ is great (for instance, about 55°), so long as the guide plate 52 is made of a metallic material with a small coefficient of friction. However, when sheets are continuously passed, the preceding sheet which is caused to run in the direction opposite to the sheet leading edge diverting direction serves as a guide surface as explained previously by referring to FIG. 11. Therefore, due to the great coefficient of friction of the sheet, it could happen that the following sheet is dragged by the preceding sheet and is then caught by the downstream-side reverse roller 57.

With the above-described points taken into consideration, sheet reversing and passing tests were conducted by changing the direction of the rising portion of the guide plate 52, the angles $\theta_1$ and $\theta_2$, and the gap between the reversely-rotating roller 53 and the pinch roller 54.

The results show that stable sheet reversing and transportation can be attained, regardless of the presence of curls and the direction thereof in the sheet so long as the following conditions are met:

(1) The guide plate 52 is made in such a shape and attached in such a direction as to satisfy the conditions of $\theta_1 <$ about 50° and $\theta_2 >$ about 135°.

(2) The gap between the reversely-rotating roller 53 and the pinch roller 54 is decreased in such a manner that the two rollers can come into contact with each other after the rear end portion of the sheet is detached from the upstream-side reverse roller, but before the rear end portion is not moved away from the main reverse roller 58.

Figure 18:
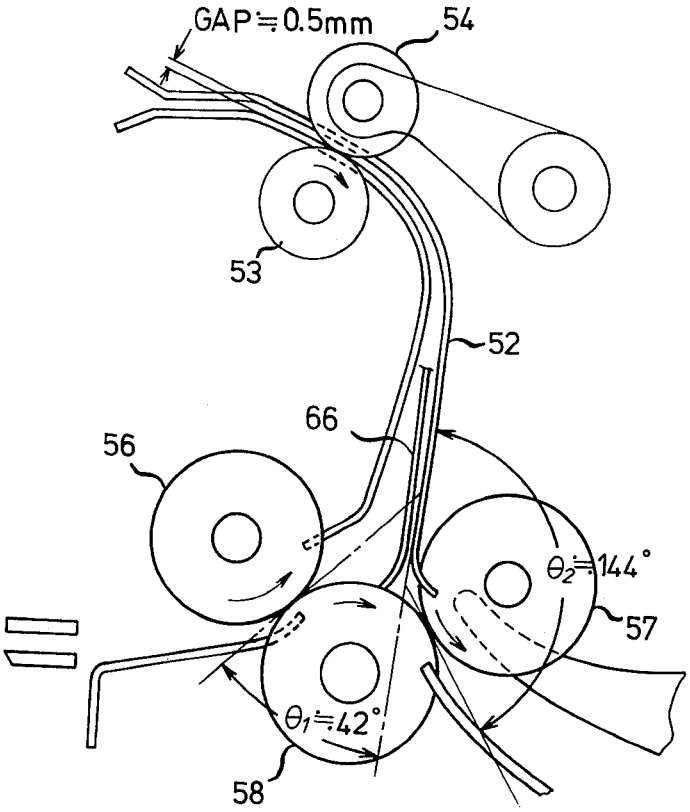
FIG. 18 is a schematic illustration of an example of an adequate arrangement of the members for the 3-roller type sheet reversing apparatus.

From the above results, the guide plate was made in such a shape and disposed in such an arrangement as to satisfy the conditions of $\theta_1 =$ about 42° and $\theta_2 =$ about 144° as shown in FIG. 18, and the gap between the reversely-rotating roller 53 and the pinch roller 54 was set at about 0.5 mm. The thus constructed sheet reversing apparatus was employed in an actual copying machine. The result was that when sheets with face-curls were caused to pass continuously, the leading edge portion of each sheet was securely introduced into the sheet reversing section, and, even after the rear end portion of the sheet was detached from the upstream-side reverse roller, the sheet advanced to the downstream side under the guidance of the main reverse roller, without floating from the main reverse roller. In addition to the above-mentioned improvement, the increased angle of $\theta_2$ contributed to the accomplishment of secure catching of each sheet by the downstream-side reverse roller and the main reverse roller and smooth sheet reversing and transportation, regardless of the extent of the curl, the direction thereof and variations in curl in the width direction of the sheet.

By setting the positions and shapes of the rollers and the guide plate, and the timing for reversing each sheet introduced into the sheet reversing section under the above-described conditions, stable sheet transportation and sheet reversing can be performed without being affected by the curl of each sheet.

What is claimed is:

1. In a duplex tray for a duplex copying machine, a duplex printing machine or the like, comprising:

a gate disposed on the side of an inlet of said tray, which gate can switch the sheet transportation directions from a sheet path for discharging sheets outside said machine to a sheet path for discharging sheets onto said duplex tray, and vice versa;

a pressure application member for applying pressure to the bottom of said tray such that a sheet feeding pressure is applied to a stack of sheets placed on said tray;

means for moving transversely said tray between (i) a reference position at which the position of a reference side wall of said tray coincides with the sheet passing reference line along which sheets pass through said machine and (ii) a position deviated from said reference position; and an inclined roller movable upwards and downwards and capable of lining up the sheets discharged onto said tray by moving said sheets in a slant direction and along said reference side wall of said tray which is deviated outwards;

whereby, at the time of sheet discharging, said gate is moved to the side of said sheet discharging path of said tray, and said sheet feeding pressure is released, and said tray is moved transversely so as to deviate said reference side wall of said tray slightly outwards beyond said sheet passing reference line, and said inclined roller which is driven in rotation is brought into contact with the top sheet of a stack of sheets which are stacked sheet by sheet in accordance with a one-side reference, so that said sheets are lined up and stacked in conformity with said reference side wall of said tray; and at the time of re-feeding of said sheets, said gate is switching to the side of said sheet path for discharging sheets outside said machine, and sheet feeding pressure is applied to said tray, and said tray is moved transversely until said reference side wall of said tray coincides with said sheet passing reference line, and said inclined roller is retracted from the top sheet of a stack of sheets placed on said tray, the improvement further comprising:

a single solenoid which is energized or deenergized in accordance with the discharging of sheets onto said tray, and re-feeding of sheets;

a single half-turn cam which is controlled by said solenoid through a spring clutch; and a linkage mechanism driven by said single half-turn cam for switching the positions of said gate, said sheet feeding pressure application member, said means for moving transversely said tray and said inclined roller in accordance with a mode for sheet discharging and a mode for re-feeding sheets.

2. A duplex tray as claimed in claim 1, wherein said inclined roller is driven in rotation and stopped by said single half-turn cam.

* * * * *